United States Patent [19]

Wyatt

[11] 4,418,651

[45] Dec. 6, 1983

[54] SYSTEM FOR HEATING AND UTILIZING FLUIDS

[75] Inventor: William G. Wyatt, Arlington, Tex.

[73] Assignee: Vapor Energy, Inc., Grand Prairie, Tex.

[21] Appl. No.: 394,721

[22] Filed: Jul. 2, 1982

[51] Int. Cl.[3] ..... F22B 1/02

[52] U.S. Cl. ..... 122/31 R; 122/412; 122/448 A; 126/360 A; 166/261; 431/210

[58] Field of Search ..... 122/31 R, 31 A, 412, 122/448 R, 448 A; 126/360 A; 166/261, 275; 431/210

[56] References Cited

U.S. PATENT DOCUMENTS

| | | | |
|---|---|---|---|
| 3,692,017 | 9/1972 | Glachant et al. | 126/360 A |
| 3,717,139 | 2/1973 | Guillet et al. | 126/360 A |
| 3,933,600 | 1/1976 | Dodge | 126/360 A X |
| 4,018,216 | 4/1977 | Thurley | 122/31 A X |

*Primary Examiner*—Edward G. Favors

*Attorney, Agent, or Firm*—Thomas L. Cantrell; Joseph H. Schley; Stanley R. Moore

[57] ABSTRACT

Disclosed are methods and apparatus for the controlled heating and utilization of fluids by the use of vapor generators of the kind in which a flowing fuel/air mixture is combusted for heating a stream of feedwater to produce a stream of steam and non-condensibles, preferably at low pressure. The hot stream is then heat exchanged with a stream of the fluid desired to be heated and utilized, to heat it to the level desired for use, including partly or completely vaporizing it, if the use so requires. The fluid may be divided into two or more streams during the heat exchange, with different amounts of heat delivered into each stream. Preferably, the heat exchange is so conducted as to condense the steam from the stream of steam and non-condensibles, and the condensate so formed is selectively recycled to the vapor generator as feedwater. Also, disclosed are means for incorporating a feedback control network including remotely actuatable valves, temperature sensors and related feedback devices for utilizing the steam of heated fluid for commercial heating of petroleum reservoirs and pipelines as well as comfort heating of living spaces.

26 Claims, 7 Drawing Figures

WARM WATER
INJECTION WATER
NON-CONDENSIBLES
FUEL
AIR
FEEDWATER
ADDITIVES
10
11
12
13
14
15
16
17
18
19
20
21
22
23
25
26
27
28
29
30
31
33

SYSTEM FOR HEATING AND UTILIZING FLUIDS

BACKGROUND OF THE INVENTION

The present invention relates to hot water supply systems and, more particularly, to a versatile hot water supply system incorporating a vapor generator and feedback control means.

The prior art generally recognizes boilers as the traditional means for supplying heat energy in many applications despite the fact that they may not be easily matchable to the temperature, pressure, and flow requirements of a particular application. One difficulty in this regard flows from the fact that in a boiler these parameters are not independent, and changes in heat throughput at constant flow, for example, are accompanied by changes in temperature, pressure, or both. In addition, conventional boilers are expensive and complex, and require extensive maintenance. In most instances the boiler feedwater requires chemical treatment to retard corrosive wear of the boiler.

Hot water systems of conventional design generally incorporate a feedwater boiler where large amounts of cold water are stored and heated to a selected temperature which depends upon demand requirements. Applications include industrial hot water feed lines, schools and office buildings and commercial hot water markets such as car washes and airports. Water demand generally fluctuates in those instances and much energy can be lost from heating large boilers during time of inactivity. Commercial hot water markets may also include construction sites in locations often not accessible to utility lines. This presents the obvious problem of how to heat the water.

Various prior art embodiments have addressed the need for versatile hot water supply systems which meet the needs of intermediate flow demands and remote utilization. Certain prior art systems have incorporated "in-line", electrical heating elements which directly engage the high pressure water flow along a select flow path for heating the water to a select temperature as it passes through the heater. Problems of cost, fuel energy conservation and limited demand capacity have been found to be prevalent in such systems.

Commercial hot water systems must overcome numerous obstacles, yet the potential applications are plentiful. High pressure flooding of hot water in petroleum reservoirs is a proven technique. Equally feasible, both economically and logistically, is vaporization of LPG or propane for combustion. Similarly, line heating of natural gas and/or heavy oil pipelines to promote flow or to avoid condensation therein is a present need. Such commercial/industrial applications which are remotely disposed from power utility systems present a myriad of technological problems for maximally efficient hot water systems. Concrete batching plants, for example, are generally used in areas not having hot water; much less energy supply lines. Such applications include concrete paving of remote areas and/or the building of concrete structures. Hot water boilers and/or other prior art hot water heating elements are of extremely limited use in such markets. While combustion fuel is, or may be plentiful, means for safely and efficiently utilizing combustible fuel to meet varying hot water supply demands is severely limited by prior art designs.

One difficulty encountered in combustion fuel hot water supply units of the prior art is the high carbon monoxide content in the end product. This difficulty is particularly prevalent in prior art fuel vaporizers. Such noxious vapor content is objectionable around human occupation; a generally occurring condition where hot water is needed. High carbon monoxide production is traceable to incomplete combustion, in the main, which is in turn traceable, in part, to difficulties in maintaining stable flames in most prior art vaporizing units. Excessive quenching of flames through direct radiative and convective contact between the flame and the feedwater is often the cause. The advantages that vapor generators might have in hot water supply systems have been overlooked in light of these problems and in view of the low pressure steam produced. To be effective, low pressure steam must be automatically convertible to high pressure hot water upon demand. Prior art boiler systems have not shown such capabilities and these hot water supply problems still exist. For this reason vapor generators have been developed for meeting such commercial and technological needs.

Vapor generators of the kind shown in U.S. Pat. No. 4,211,071 and in my copending U.S. patent application Ser. Nos. 37,029 filed May 8, 1979; 261,702 filed May 8, 1981; and 261,703 filed May 8, 1981, represent alternate means for supplying energy. The generators therein set forth material advantages over conventional boilers in the way of equipment simplification and reduced maintenance requirements. However, the product stream from a vapor generator contains a relatively high proportion of non-condensibles, which is undesirable in many applications. In the case of older forms of vapor generators, the non-condensibles include pollutants such as carbon monoxide and unburned hydrocarbons. In addition, when a high pressure stream is required, capital and operating costs for the air compressor stage of a vapor generator are high. It has also been observed that some energy consuming applications require a liquid product stream which is at a fairly high temperature and a very high pressure. Hot water flooding systems for recovering oil from reservoirs are one example. Other examples include the aforementioned heating of natural gas and petroleum pipelines.

The method and apparatus of the present invention address such hot water supply needs and overcome the problems of the prior art by providing a low pressure, vapor generator in which a demand sensitive product stream substantially free of carbon monoxide and other deleterious end use gases is produced. The vapor generator of the present invention may also be used in remote areas to produce a watersteam product at a sufficiently high heat energy state to convert large cold water supplies relatively quickly into a hot water at either low or high pressure.

SUMMARY OF THE INVENTION

The present invention relates to a hot water supply system incorporating a low pressure vapor generator for providing either low pressure or high pressure hot water in a demand-sensitive configuration. More particularly, one aspect of the present invention relates to a hot water supply system utilizing a combustion of fuel and air and the mixture of water, steam and non-combustibles to provide resultant hot water at a select temperature.

The system of the present invention comprises a vapor generator of the type having a chamber for the receipt and combustion of a fuel-air mixture. Means are provided for supplying feedwater to the chamber for the conversion of feedwater, fuel and air to steam and non-condensibles therein. A low pressure stream of steam and non-condensibles is generated by combusting a stream of mixed fuel and air and mixing the products of combustionn therefrom with a stream of feedwater, and the exchange of heat between that product stream and one or more streams of the fluid of interest to bring it (or them) to the particular temperature, pressure, and flow conditions required by, or desirable for, the use to which the fluid is put. To maximize efficiency, it is preferred that the heat exchange be so conducted that the steam is condensed from the product stream. It is also preferred that the condensate be separated from the non-condensibles and selectively recycled as a feedwater to the generator stage. Means may also be provided for sensing the temperature of the resultant hot and heated waters and producing output signals in response thereto. Control means are provided for detecting the output of the sensing means and controlling the supply water delivery means for regulating the flow of the supply water and, correspondingly, the temperature of the resultant hot water.

When the fluid of interest is to be brought to a high pressure for use, whether vaporized in the heat exchange step or not, it may be pressurized by being pumped upon as a cool liquid upstream of the heat exchange step. Such pressurization of fluid of interest need not be accompanied by a parallel increase in the pressure of the stream of steam and non-condensibles. As a consequence of these features of the invention, a highly pressurized fluid of interest may be produced with relatively low costs (both capital and operating) for pumps and blowers. The pressurizing pump, since it is working on a cool liquid, is relatively small and trouble-free, as compared to a pump working on a hot liquid, or a vapor. The air blower for the combustion system is also relatively small and low in operating cost since the steam and non-condensibles side of the system is operated at low pressure, notwithstanding the high pressure of the fluid of interest output.

As was mentioned above, it is preferred that the exchange of heat result in condensation of the steam in the product stream of the vaporizer. Such an operating condition tends to maximize efficiency by utilizing the heat of vaporization stored in the product stream as well as its sensible heat in both the vapor and liquid stages. The condensate is a very pure warm water which is quite suitable as a partial or total source of feedwater for the vapor generator, thus further enhancing efficiency. Condensate which is not so used may be employed as an auxiliary source of warm water for general utility purposes.

In accordance with another aspect of the invention, an improved vapor generator is provided in conjunction with a water storage unit having temperature and high and low water level sensing units. Data from the sensing units is inputted into the control unit to activate the cold water feed into the heat exchanger. The storage tank water may also be used at high or low pressure by the incorporation of an additional pumping unit. In addition, the temperature of the holding tank water may be controlled by the addition of high heat, steam-water flow from the generator. This aspect of the invention facilitates high heat storage with no high pressure considerations. Moreover, chemical additives may be incorporated in the storage tank pumping unit at various stages and/or temperatures for select applications in industry, commercial hot water markets and/or petroleum pipeline systems.

BRIEF DESCRIPTION OF THE DRAWINGS

For a more complete understanding of the present invention, and for further objects and advantages thereof, reference may be now had to the following description taken in conjunction with the accompanying drawing in which:

FIG. 1A is a fragmentary diagrammatic view of an alternative application of the invention of FIG. 1.

DESCRIPTION OF THE PREFERRED EMBODIMENTS

Figure 1:
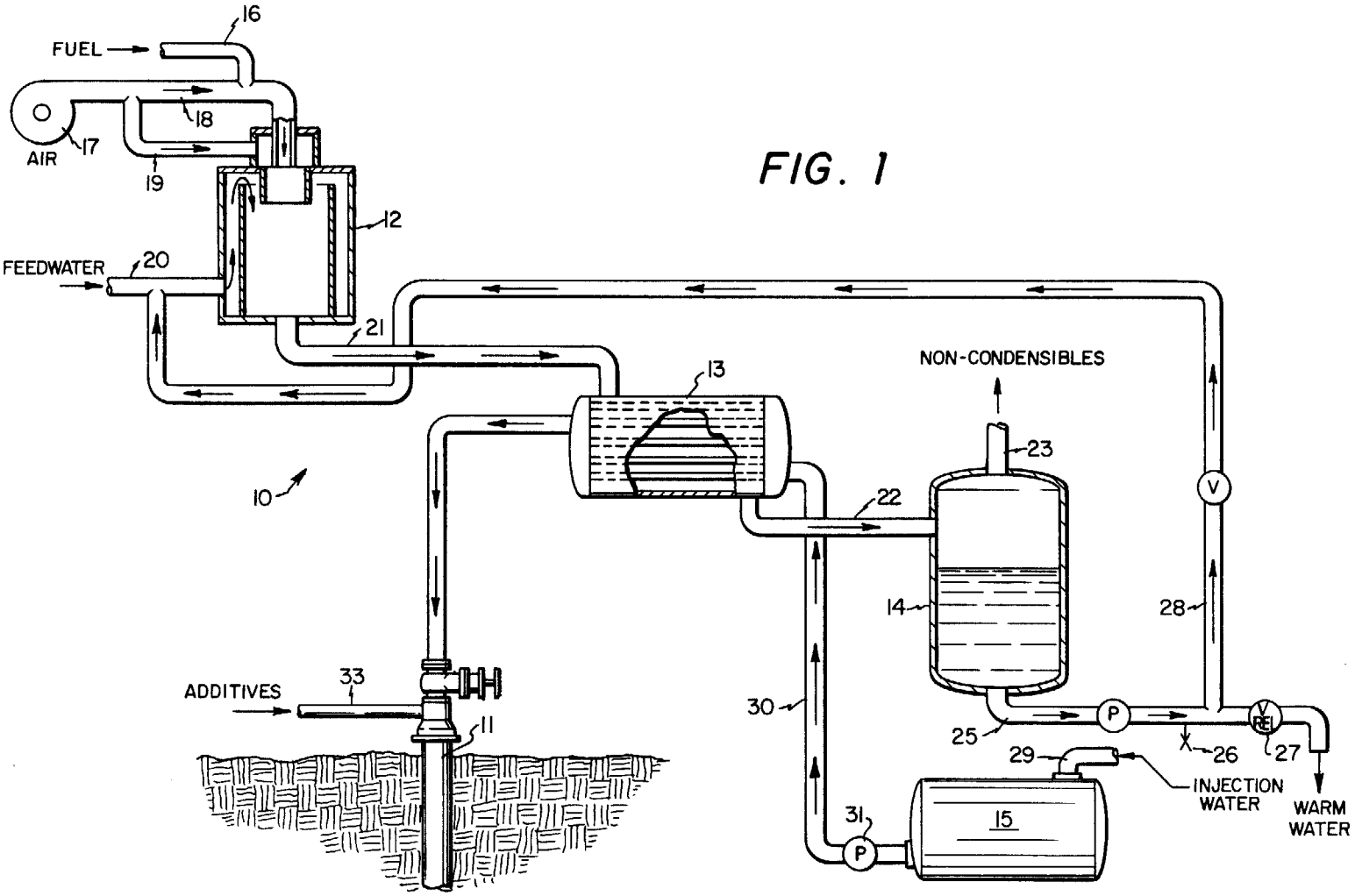
FIG. 1 is a diagrammatic side elevational view, partly in section, of an embodiment of the invention as applied to a system for heating water for injection into a petroleum formation.

Attention is directed first to FIG. 1, where a system of the invention is designated generally as 10, and where it is shown set up to supply hot high pressure water for injection into an oil well 11. The system of FIG. 1 includes a vapor generator 12, a heat exchanger 13, a separator 14, and an injection water supply tank 15, together with lines connecting these elements in accordance with the invention, and with pumps and valves at selected locations in side lines.

As is explained in more detail in my above-mentioned U.S. Pat. No. 4,211,071, generator 12 produces a product stream containing steam and hot non-condensibles primarily nitrogen and carbon dioxide by the combustion within the generator of fuel with air in the presence of feedwater. Fuel is introduced through line 16, combustion air through blower 17 and lines 18, 19, and feedwater through line 20. The product stream leaves the generator 12 through generator output line 21, which delivers it to the shell side of heat exchanger 13. Typically, the product stream is at relatively low pressure, such as 5 psig (351.5 grams per sq. centimeter gauge), and is fairly warm, such as 149° C.

In heat exchanger 13, the product stream gives up heat to the fluid flowing through the tube side of the exchanger. It is preferred that the pressure and flow conditions be such that the steam in the product stream be condensed in the course of its traverse of the shell side of the exchanger. Under preferred conditions, then, the stream leaving exchanger 13 through exchanger output line 22 is a mixture of warm liquid water and non-condensibles.

Exchanger output line 22 delivers this mixture to separator 14 where the non-condensibles and the warm water separate, with the non-condensibles leaving the separator at the top through exhaust line 23. The separated water is pumped from the separator through separator output line 24, by pump 25 to leave the system through valves 26 and 27, or to be recycled for use as generator feedwater through recycle line 28, which is connected between lines 25 and 20.

Injection water is introduced into tank 15 through line 29. In many cases it will be preferred that the injection water be "connate water", that is, water originally derived from the formation being treated and thus having the same ionic content as formation water. Connate water is thus in equilibrium with the minerals of the formation and when returned to contact with them does not cause swelling or other untoward effects. The injection water may also be artificially compounded connate water, or, in the case of formations which are not sensitive to the ionic content of the injected water, from surface water. In the latter two instances, some of the water may comprise condensate from line 25, which has the advantage that its heat is delivered to the formation being treated.

Injection water is pumped from tank 15 to the tube side of exchanger 13 through line 30 by pump 31, which develops the pressure desired for delivery into the formation. In its passage through exchanger 13, the injection water picks up heat and temperature from the vapor generator product stream. Various additives may be added through line 33. It should be noted that pump 31 works on the injection water while it is cool, which simplifies the pump requirements as compared to a pump working on hot water. Also, the product stream of the vapor generator is at a low pressure, while the injection water is injected into the well at high pressure. Furthermore, pump 31 for pressurizing liquid is a smaller item of capital expense than would be a compressor 17 capable of bringing an equivalent quantity of combustion air to the same pressure.

FIG. 1 can be taken to illustrate another embodiment of the invention if one regards tank 15 as charged with liquid carbon dioxide rather than water. In such an embodiment the operation is substantially the same as described above, except that a change of state takes place in the carbon dioxide stream flowing through the tube side of the heat exchanger, as it extracts heat from the vapor generator product stream flowing on the shell side. Carbon dioxide, under pressure, and vaporized, is delivered to well 11 through line 31.

Figure 2A:
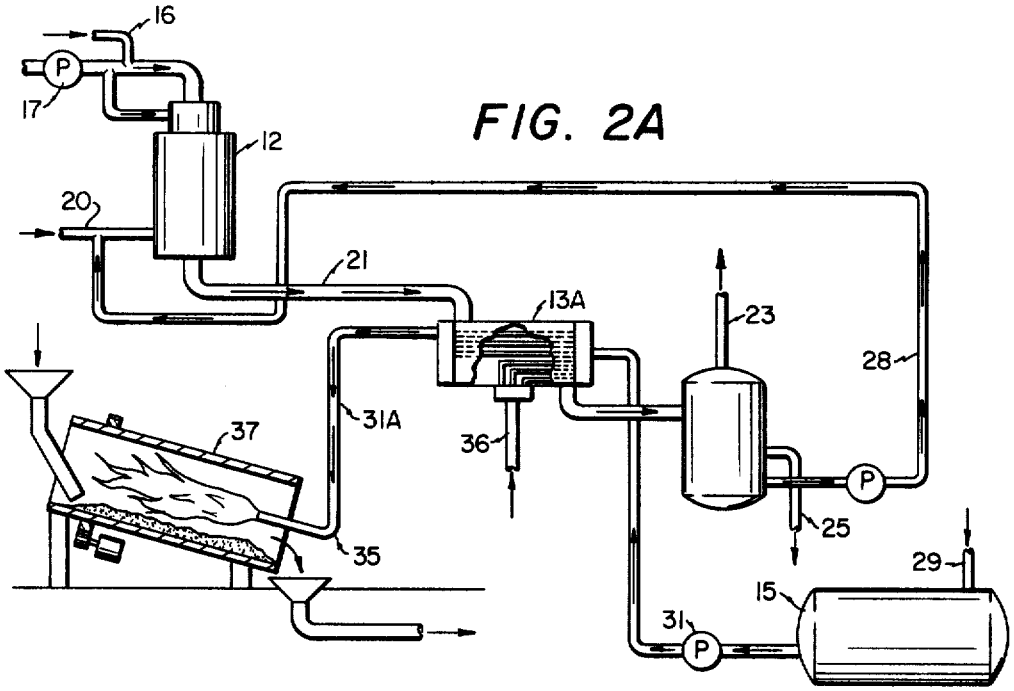
FIG. 2A is a diagrammatic side elevational view, partly in section, of another embodiment of the invention, as applied to a system for vaporizing propane or the like for combustion in a burner.

FIG. 2A shows another embodiment of the invention. Parts which are essentially the same as those shown in FIG. 1 are given the same reference character; those which are modified are given the same number with the addition of the letter "A". In the embodiment of FIG. 2A, tank 15 is charged with liquid propane or another liquified natural gas product, which is to be vaporized prior to delivery to burner 35 in kiln 37. The energy required for vaporization is generated in vapor generator 12 and heat exchanged with the propane in heat exchanger 13A. The vaporized propane leaves the exchanger through line 31A and is delivered to burner 35.

Heat exchanger 13A differs from heat exchanger 13 of FIG. 1 in that its tube side is divided, with some of the tubes issuing into line 31A and the remainder issuing into line 36. While such an arrangement would have limited application when the tube-side working fluid is propane, it is an attractive feature of the invention, because it makes it possible to divide the tube-side working fluid into two or more streams to which differing amounts of heat are added from the shell side product stream from the vapor generator, thus improving flexibility and efficiency.

Figure 2B:
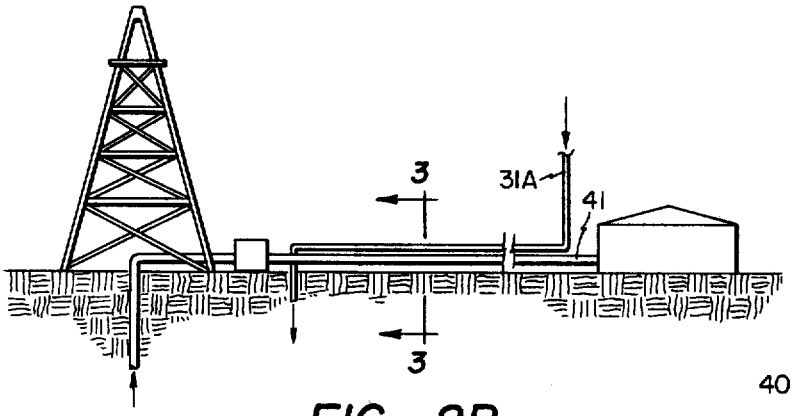
FIG. 2B is a fragmentary side elevational view of a system utilizing the product stream of the invention for heat tracing a pipeline for heavy oil.
Figure 3:
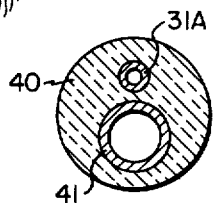
FIG. 3 is an enlarged cross-sectional view taken of the line 3—3 of FIG. 2B.

In FIGS. 2B and 3 there is shown an alternate embployment of the high temperature stream produced in line 31A, which in this case is presumed to be steam. By being bound in an insulation package 40 closely adjacent heavy oil line, the steam line 31A delivers heat to the flowing oil in line 41 to reduce its viscosity so it will be pumpable, and at lower cost.

Figure 2C:
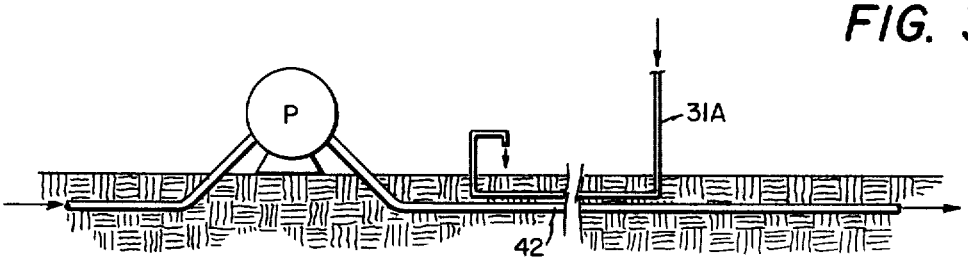
FIG. 2C is a fragmentary side elevational view of the system utilizing the product stream of the invention for heat tracing a pipeline for natural gas to prevent condensation of natural gasoline liquids therein.

In FIG. 2C, still another alternate employment of the high temperature stream produced in line 31A, in this case again assumed to be steam. Steam line 31A traces a gas pipeline 42 to prevent natural gasoline fractions contained in the gas from condensing out of the flowing gas stream.

Figure 4:
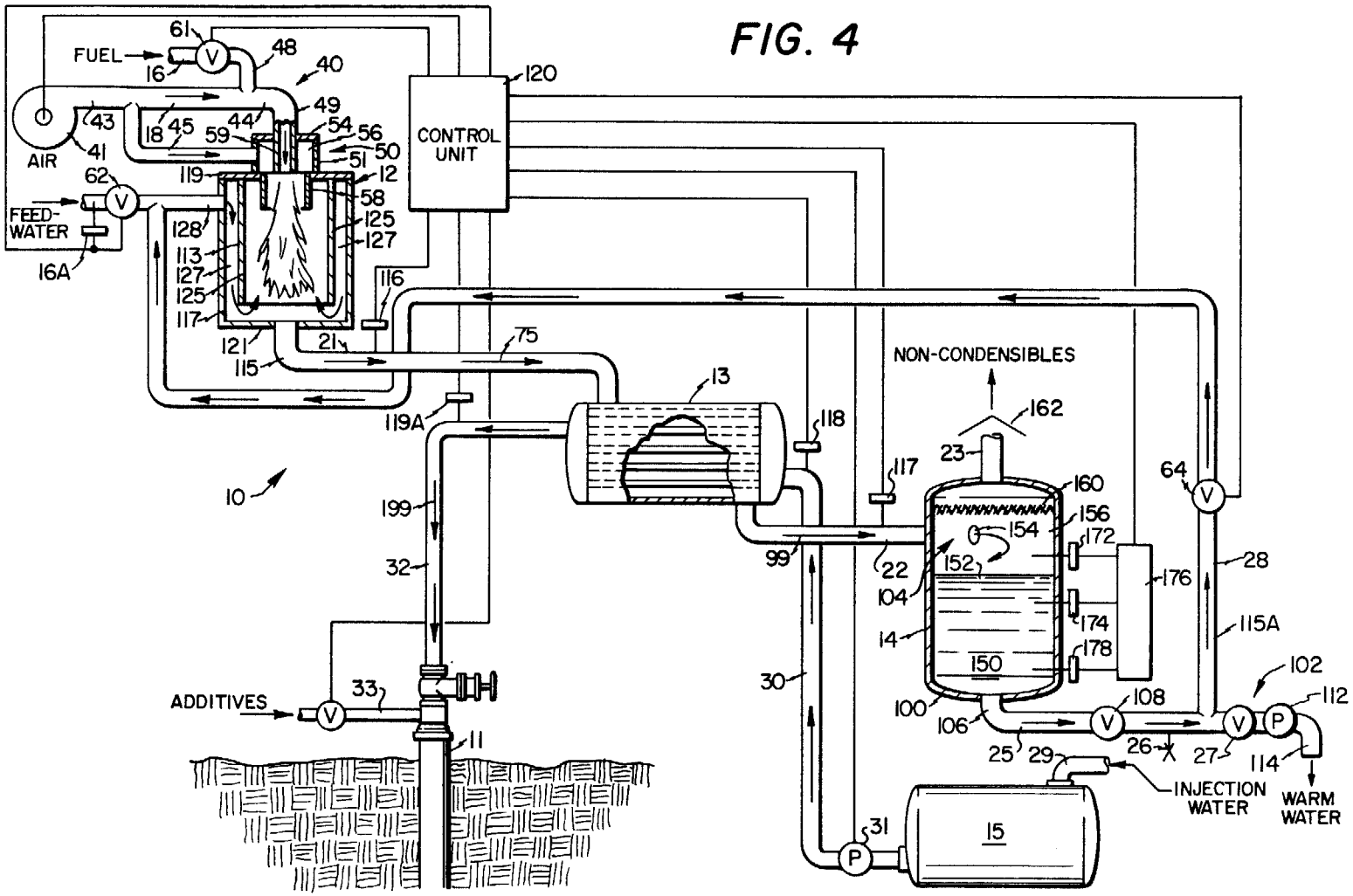
FIG. 4 is an alternative embodiment of the system of the present invention set forth in FIG. 1, including a feedback control network.

Referring next to FIG. 4, there is shown a diagrammatic view of an alternative embodiment of a method and apparatus for hot water production constructed in accordance with the principles of the present invention. A hot water supply system 10, diagrammatically shown, includes a low pressure vapor generator 12, a heat exchanger 13, a separator 14, and an injection water supply tank 15, together with lines connecting these elements in accordance with the invention, and with pumps and valves at selected locations in said lines.

The system of FIG. 4 also includes a programmable temperature-flow control unit 120, feedwater supply means, associated flow conduit, and sensor and flow control means. The control unit 120 is coupled to upstream and downstream temperature sensors 116 and 117, respectively, which delay data to unit 120 for temperature-sensing and responsive actuation within system 10. Control unit 120 is programmed to responsively actuate generator 12 and the flow valves governing the inflow and downstream heat exchanger operation to produce a heated fluid body 99 and 199 at a selected temperature and flow. In this manner, specific hot water demands of time, temperature, volume and pressure, can be efficiently met on an immediate use or long-term storage basis. Moreover, the demands for the desired hot water can be met at high or low pressures, with or without chemical additives, and with apparatus lending itself to set-up and use in remote areas where utility services may not be available.

Addressing now the vapor generator 12 of FIG. 4, there is shown an alternative method of heating the feedwater without exposing it directly to the combustion occurring therein. Main combustion chamber 113 is preferably an upright closed-ended elongated cylinder adapted to enclose the bulk of the flame generated in accordance with the invention. To the bottom of chamber 113 is connected a product exit line or conduit 115. Chamber 113 has a cylindrical outer wall 117, and closed ends 119, 121. Provision is made for the delivery of feedwater to the area around the main combustion chamber. These provisions include an upper inlet water line 123, and internal cylindrical wall or tube 125. Tube 125 is attached to top end 119 and terminates a selected relatively small distance short of bottom end 121. An annular space 127 is thus established between walls 117 and 125 extending over substantially the full height of chamber 113 and the combustion occurring therein.

In operation of the generator 12 of this particular embodiment, feedwater is delivered into annular space 127 through inlet line 123. The water is heated as it flows downwardly through the annular space or jacket 127 and under tube 125. During the first part of the downward travel, the water absorbs heat conductively from the shielded portion of the flame. During the final part of its downward flow in jacket 127, the feedwater is substantially vaporized therein to form steam that becomes part of the product stream leaving jacket 127 and chamber 113 via conduit 115.

The fuel and air delivery system of the invention is designated generally as 40. It includes an air compressor 41, having an air filter (not shown). Various types of compressors having suitable output pressures and delivery rates may be employed. The compressed air issuing from compressor 41 enters conduit 43.

The compressed air stream in conduit 43 is divided into two streams bearing a selected ratio (volumetric or mass) to each other. The division is accomplished by providing mixing conduit 44, which is an extension of air conduit 43, and branch or auxiliary air conduit 45. Conduits 44 and 45 are each connected to the precombustion chamber 50. Preferably, the volume of flow through auxiliary air conduit 45 amounts to about 8 to 10 percent of the air flow through mixing conduit 44.

Immediately downstream in mixing conduit 44 there is provided a fuel inlet 48. Flow in conduit 44 is quite turbulent and it is desirable to introduce the fuel at this point to initiate thorough and intimate mixing of the fuel and air. Furthermore, it is preferred that mixing conduit 44 be fairly long in order to provide a full opportunity for thorough mixing of the air and fuel stream before it reaches the precombustion chamber. Mixing is also enhanced by the directional change in conduit 44 at bend or elbow 49. The diameter of mixing conduit 44 is selected in view of the desired flow rate so that the lineal velocity of the mixture flowing therethrough is substantially equal to or slightly greater than the flame propagation speed, so that the flame established and maintained in the precombustion chamber cannot migrate back up into conduit 44 or its bend 49. For example, with a designed fuel flow of 0.48 cubic meters per minute, mixed with a stoichiometric quantity of air, a nominal conduit diameter of about 5.08 centimeters is satisfactory.

The precombustion chamber of the vapor generator of the present invention is designated generally as 50. It includes a cylindrical housing 51, somewhat larger in diameter than opening 52 in the upper end 119 of chamber 13. The upper end of housing 51 is closed by plate 54. A frame enclosing skirt or shield 59 depends downwardly from plate 54, terminating short of opening 52 so that a circular slot 55 is defined between the outer edge of the skirt and the inner edge of the flange. A cylindrical annular space 56 is defined between skirt 59 and housing 51. Conduit 44 is attached to the top of the precombustion chamber to deliver a fuel-air mixture into the space within shield 59. Conduit 45 is attached to the side of the precombustion chamber to deliver auxiliary air into the annular space 56.

A pilot burner assembly (not shown) is mounted on precombustion chamber 50 so that its mouth opens preferably into the chamber near the junction of conduit 44 and plate 54, and within skirt 59. In the vaporizer 113, a second flame enclosing shield or skirt 58 is mounted to top end 119 to depend downwardly. The pilot flame thus formed in the pilot burner issues into the precombustion chamber to initiate combustion.

As can be seen from the foregoing, three primary input streams are involved in the generator 12: fuel gas; combustion supporting gas (preferably air from an electrically-driven blower or compressor); and water. There are thus three primary points of control which are coordinated by control unit 120: fuel, air and water. Such control means are setforth in my copending application Ser. No. 261,703 described above. Fuel metering valve 61 and feedwater flow valve 62 are provided, each remotely actuatable by control unit 120. During start-up, fuel gas and sparking current are supplied to the pilot burner. During operation, a series of monitoring devices monitor various operating conditions and turn the generator 12 off, or prevent its start-up if it is already off, when a condition departs from a desired value or range of values. These monitors include thermostats, water level sensors and fuel pressure switches which provide generator operations with low level carbon monoxide production.

Still referring to FIG. 4, the particular embodiment of the present invention shown and described herein produces a product stream containing steam and hot non-condensibles, primarily nitrogen and carbon dioxide, by the combustion within the generator 12 of fuel with air. Fuel is introduced as above described and combusted with air. Feedwater is introduced through line 123 and mixes with the products of combustion. The resulting product stream leaves the generator 12 through generator output line 115, which delivers it to the shell side of heat exchanger 13 as described above. The product stream is, again, at relatively low pressure, such as 5 psig (351.5 grams per sq. centimeter gauge), and is fairly warm, such as 149° C.

Once sufficient fuel and supply water is made available, the system of FIG. 4 can produce hot water of selectable temperature and programmable volume and do so within a wide range of elective times frames. The control of these production parameters is made possible by coordination of generator 12 operation, fluid temperatures and regulated flow rates from the control unit 120. Referring again to FIG. 4, the volume of water from line 123 may be controlled by valve 62 actuatable by control unit 120. The valves 62 and 61 may be of the conventional solenoid actuated variety. To coordinate such efforts, the control unit 120 preferably includes a conventional programmable computer capable of being programmed with the desired temperature, volume and time frame in which the final product is needed. The system 10 startup is thus the first phase of operation. The unit 120 also coordinates a second phase of continued operation and therein must sense variable input data, analyze the data relative to the production parameters and make responsive changes to the various control areas of the system 10.

In Phase I operation, the desired temperature, volume and demand time for hot water are programmed into the control unit 120 as production parameters. Ambient temperature sensors **16*a* and 118 communicate to the control unit 120 the initial working temperatures of the raw feedwater and the reservoir supply water to be heated, respectively. This data forms a basis for a determination of a projected initial mixture ratio of feedwater and supply water. The data of desired discharge volume to the heat exchanger 13 is then determinative of the projected flow rates of the respective constituents. The control unit 120, having received the above data and determinative operational parameters, then activates one of a series of preprogrammed start-up sequences of the generator 12** to cause it to operate at the most optimal fuel-air-water ratio for the particular parameters involved.

It may thus be seen that the control unit 120 preferably includes a plurality of preprogrammed, Phase I start-up sequences for the various categories of production parameters through heat exchanger 13. These sequences are designed for maximizing operational efficiency through the Phase I start-up at particular demand levels. For example, if 3785.3 liters (V1) of water at 38° C. (T1) were needed over a 3-hour time frame, ($A_1$) the generator 12 could be run at a much lower combustion level ($L_1$) than the same remaining production parameters needed over a 1-hour time period conserving fuel and maximizing the efficiency of operation. The controlled combustion level ($L_2$) could likewise be maintained at the ($L_1$) level even if the temperature ($T_2$) were raised to 82° C., if the demand time frame ($A_2$) was expanded sufficiently; a combustion level ($L_3$), if a substantially higher volume ($V_3$) of heated water was needed. The algorithm for solving such operational requirements is determined by conventional mathematical, programming methods and fed into control unit 14.

Once the system 10 passes through the Phase I start-up and becomes operable at the flow rates and settings which were projected by control unit 120 to be optimal for a particular demand, the actual fluid temperatures become controlling which constitutes the second phase of operation. The vapor generator 12 and heat exchanger 13 need a predefined period to reach a stabilized output. Following this stabilization period, a Phase II program in control unit 120 takes over. This program is likewise determinable by conventional mathematical programming techniques and includes receiving temperature data from sensors **16*a*, 116, 118, 119A, and 178** for analyzing it.

Sensor 116 detects the temperature of the upstream fluid product of generator 12, described above. The heat content of this high temperature fluid, referred to as fluid product 75 comprising evaporated feedwater and non-condensibles, is readily calculable and the control unit 120 performs a comparison with the heat exchanger output and associated sensors. The heat content of the fluid product 75 engaging the heat sensor 16 is readily calculable from the volume of input feedwater and the volume of fuel and air. Once these factors are fed into the control unit 120, the heat content ($Q_1$) of the fluid product 75 detected by temperature sensor 116 is determinable. An optional heat content (Q) is programmed for desired output from the exchanger 13. The actual output temperature from sensor 119 and heat content ($Q_2$) is then compared to the programmed value of (Q) and sensor 119A and adjustments in the three primary points of control of the generator 12 are effected by unit 120.

The heat content of the fluid 75 may also be used to vary the volume of flow, of "cold", unheated supply water from cold water valve 62 and warm supply water from valve 64. The temperature of the raw feedwater does not have to be known although sensor **16*a* is so shown as a source of usable input data. Temperature sensors 118 and 119A can be used to measure downstream temperatures, and heat exchanger operation, and relay information to control unit 120. If the temperature at 119A is too low, either higher heat content from the generator 12 is needed or less "cold" water through valve 62. This decision is implemented through control unit 120 which is programmed to adjust the respective flow rates toward the optimal efficiency levels discussed for Phase II operation. In this manner, the system 10 is not limited in operational scope by any one factor. Both "cold" feedwater supply volume, heat exchanger operation, and vapor generator heat output (Q) may be adjusted according to changes in operation conditions. Each can be automatically programmed in the present invention to balance parameter variation deficiencies in other areas of the system to produce a heated fluid body 199 from exchanger 13**, discharging at the most optimal rate for a desired temperature, volume and pressure.

The output rate of the discharging fluid body 199 produced in system 10 may be seen to be directly regulated by pump 31 in conjunction with the aforesaid operational parameters. An input data terminal 80 is illustratively shown in FIG. 1 and allows above described programming of control unit 120. The optimal temperature, volume, pressure and rate of flow for the resultant fluid body 199 discharged from heat exchanger 13 is is thus regulated by the control unit 120 in conjunction with the scheduled programming and actual parameters encountered. The fluid body 99 within the line 22 generally comprises low pressure, evaporated and condensed feedwater and the non-condensibles produced by the generator 12. In certain applications, this active fluid mixture may be directly usuable. Such use depends upon the "upstream capacity" which refers to the operation level of the generator 12 and volume of water available. The present invention also provides the capacity of a high volume, high pressure, hot water discharge through the incorporation of a downstream storage tank 100. This particular embodiment permits the relatively low pressure, fluid discharge from heat exchanger 13 to be collected for use in a myriad of high or low pressure applications. The storage tank 100 includes an ouput pumping network 102 and input settling system 104. The pumping network 102 comprises a discharge pipe 106 in combination with a regulating valve 108. A pump 112 then creates the requisite discharge pressure and channels the discharge water through conduit 114 to its end use or back through return line 115A through valve 64 to generator 12.

Referring particularly now to the right hand portion of FIG. 4 comprising the tank 100, hot water 150 may be maintained at a level 152 beneath an output port 154 in the side wall 156 of the tank. The port 154 is in direct flow communication with heat exchanger 13 and may serve as a discharge port for said exchanger. The configuration of tank 100 is preferably such that the port 154 discharges the active fluid body 99 in a tangential fashion. A tangential entry creates a vortexual swirl of the heated supply water-evaporated feedwater mixture. In the vortexual swirl, the non-condensibles are allowed to separate out from the mixture to leave usable hot water 150. The non-condensibles and unmixed steam of the discharging fluid body 99 rise upwardly within the tank 100. A demisting screen 160 is provided to collect and condense rising steam and return it to the settled, hot water 150 therebelow. A vent 162 then permits escape of the non-condensibles.

In operation, the tank 100 is coupled to a water level sensor package 176 comprising an upper and lower level detector 172 and 174, respectively. Water level signals from detectors 172 and 174 are received by control unit 120 for coordination of the production of fluid body 99 and heat exchanger output simultaneously. Temperature sensor 178 may be provided in tank 100 to monitor the temperature of the stored water 150. This temperature may be received and relayed by sensor package 176 to control unit 120. In this manner, discharge fluid 99 with an increased heat content can be provided to heat the stored water 150 as necessary to maintain its usefulness over prolonged storage periods.

It is thus believed that the operation and construction of the present invention will be apparent from the foregoing description. While the method and apparatus shown and described has been characterized as being preferred it will be obvious that various changes and modifications may be made therein without departing from the spirit and scope of the invention as defined in the following claims.

I claim:

1. A hot water supply system utilizing a combustion of fuel and air and the mixture of water, steam and non-combustibles to provide resultant hot water at a select temperature, said system comprising:

a vapor generator of the type having a chamber for the receipt and combustion of a fuel-air mixture;

a means for supplying feedwater to said chamber for the conversion of said feedwater, fuel and air to lower pressure steam and non-condensibles therein;

means for conveying said low pressure steam and non-condensibles away from said vapor generator;

pump means for delivering a stream of relatively cool water at high pressure from a source thereof;

a heat exchanger for effecting heat exchange between said low pressure stream of steam and non-condensibles and said stream of cool high pressure water to heat the water stream to a desired temperature without substantially reducing the pressure thereon, while condensing at least some of the steam from said stream of steam and non-condensibles;

means for sensing the temperature of said resultant heated water and producing an output signal in response thereto; and control means for detecting the output of said sensing means and controlling the flow of said feedwater and high pressure cool water for regulating the flow and temperature of said resultant high pressure heated water.

2. The apparatus as set forth in claim 1 wherein said system includes means for delivering said stream of heated high pressure water from said heat exchanger into the bore of a well communicating with a reservoir.

3. Apparatus in accordance with claim 1 and further comprising means for introducing an additive to said stream of heated high pressure water.

4. Apparatus in accordance with claim 1 and further comprising means for separating said condensed steam from said non-condensibles after their passage through said heat exchanger.

5. Apparatus in accordance with claim 1 and further comprising means for recycling at least some of said condensed steam to said vapor generator as feedwater therefor.

6. The apparatus as set forth in claim 1 wherein means are provided for sensing the temperature of the steam and non-condensibles produced by said vapor generator and producing an output signal in response thereto.

7. The apparatus as set forth in claim 6 wherein said control means is in communication with said steam temperature sensing means for regulating the operation of said vapor generator.

8. The apparatus as set forth in claim 1 wherein said apparatus includes a second mixing chamber for receiving and storing said resultant hot water.

9. The apparatus as set forth in claim 8 wherein said second mixing chamber includes a pump for emitting said resultant hot water from said chamber at select flow rates and pressures.

10. The apparatus as set forth in claim 8 wherein said second mixing chamber includes means for condensing steam and mist within said chamber.

11. The apparatus as set forth in claim 8 wherein said second mixing chamber includes at least one water level sensor for detecting the water level within said chamber and producing an output signal in response thereto.

12. The apparatus as set forth in claim 11 wherein said control means includes means for receiving said water level signal and actuating said vapor generator in response thereto.

13. Apparatus for providing at least one stream of heated fluid comprising:

means for delivering a stream of fluid from a source thereof toward at least one point of use thereof;

means for generating a low pressure stream of steam and non-condensibles by heating a stream of fluid from the combustion of a flowing fuel/air mixture;

means for effecting heat exchange between said stream of fluid and said stream of steam and non-condensibles to add heat to said stream of fluid;

means for sensing the temperature of said stream of fluid and said steam and non-condensibles and producing an output signal in response thereto; and control means for detecting the output of said sensing means and regulating the flow and temperature of said fluid and said steam and non-condensibles.

14. Apparatus in accordance with claim 13 in which said heat exchange means adds sufficient heat to said stream of fluid to at least partially vaporize it.

15. Apparatus in accordance with claim 13 in which said stream of fluid is divided in said heat exchange means into at least two streams of fluid.

16. Apparatus in accordance with claim 15 in which said heat exchange means adds sufficient heat to one of said streams of fluid to at least partially vaporize it.

17. Apparatus in accordance with claim 13 and further comprising:

means for receiving said stream of steam and non-condensibles following its heat exchange with said stream of fluid and for separating any condensate resulting from said heat exchange from the balance of said stream; and means for selectively recycling at least some of said condensate as feedwater to said generating means.

18. Apparatus for vaporizing an initially liquified fuel in preparation for combustion thereof comprising:

means for delivering a stream of liquified fuel from a source thereof toward a point at which it is to be combusted in vaporized form;

means for generating a low pressure stream of steam and non-condensibles by heating a stream of feedwater from the combustion of a flowing fuel/air mixture; and means for effecting heat exchange between said stream of liquified fuel and said stream of steam and non-condensibles to add heat to said stream of liquified fuel to vaporize it, means for sensing the temperature of said stream of fluid and said steam and non-condensibles and producing an output signal in response thereto; and control means for detecting the output of said sensing means and regulating the flow and temperature of said fluid and said steam and non-condensibles.

19. Apparatus in accordance with claim 18 in which sufficient heat is extracted from said stream of steam and non-condensibles in said heat exchange means to condense the steam therefrom.

20. Apparatus in accordance with claim 19 and further comprising:

means for receiving said stream of condensed steam and non-condensibles from said heat exchange means and separating the condensate from the non-condensibles; and means for selectively recycling at least some of said condensate as feedwater to said generating means.

21. A method of producing hot water through combustion of fuel and air and the mixture of water, steam and non-combustibles to provide resultant hot water at a select temperature, said method comprising the steps of:

providing a vapor generator of the type having a chamber for the receipt and combustion of a fuel-air mixture;

supplying feedwater to said vapor generator chamber for the conversion of said feedwater, fuel and air to low pressure steam and non-condensibles therein;

conveying said low pressure steam and non-condensibles away from said vapor generator;

delivering a stream of relatively cool water at high pressure from a source thereof;

sensing the temperature of said resultant hot water and producing an output signal in response thereto; and detecting the output of said sensing means and regulating the flow of said cool water and correspondingly the temperature of said resultant hot water.

22. The method as set forth in claim 21 wherein said method includes delivering said stream of heated high pressure water from said heat exchanger into the bore of a wall communicating with a reservoir.

23. The method as set forth in claim 22 wherein method further includes introducing an additive to said stream of heated high pressure water.

24. The method as set forth in claim 21 wherein separating said condensed steam from said non-condensibles after their passage through said heat exchanger.

25. The method as set forth in claim 21 wherein said method includes the step of sensing the temperature of the steam and non-condensibles produced by said vapor generator and producing an output signal in response thereto.

26. The method as set forth in claim 25 wherein said method includes the step of communicating with said steam temperature sensing means and regulating the operation of said vapor generator.

* * * * *